US012618404B2

(12) United States Patent
Tojo et al.

(10) Patent No.: US 12,618,404 B2
(45) Date of Patent: May 5, 2026

(54) SEAL STRUCTURE FOR RECIPROCATING PUMP WITH CYLINDRICAL COLLAR PORTION

(71) Applicant: MARUYAMA MFG. CO., INC., Tokyo (JP)

(72) Inventors: Nobuo Tojo, Tokyo (JP); Yoshitaka Yamanaka, Tokyo (JP)

( * ) Notice: Subject to any disclaimer, the term of this patent is extended or adjusted under 35 U.S.C. 154(b) by 0 days.

(21) Appl. No.: 18/475,232

(22) Filed: Sep. 27, 2023

(65) Prior Publication Data

US 2024/0141889 A1 May 2, 2024

(30) Foreign Application Priority Data

Oct. 26, 2022 (JP) ..... 2022-171539

(51) Int. Cl.
*F04B 53/16* (2006.01)

(52) U.S. Cl.
CPC ..... *F04B 53/164* (2013.01)

(58) Field of Classification Search
CPC ..... F04B 53/164
See application file for complete search history.

(56) References Cited

U.S. PATENT DOCUMENTS 4,277,229 A * 7/1981 Pacht ..... F04B 53/164 417/454
5,090,087 A 2/1992 Hipple et al.
5,209,495 A * 5/1993 Palmour ..... F04B 53/164 277/926
9,285,040 B2 * 3/2016 Forrest ..... B24C 7/0015
2005/0142012 A1 * 6/2005 Padgett ..... F04B 9/1172 417/460
2018/0163719 A1 * 6/2018 Tojo ..... F04B 53/02

FOREIGN PATENT DOCUMENTS

| | | |
|---|---|---|
| JP | S54-000146 | 1/1979 |
| JP | S60-047958 | 4/1985 |
| JP | S61-064568 | 5/1986 |
| JP | S61-173861 | 10/1986 |
| JP | S63-057879 | 3/1988 |
| JP | H4-181072 | 6/1992 |
| JP | H6-288531 | 10/1994 |
| JP | 4147199 B2 * | 9/2008 |

OTHER PUBLICATIONS

English Translation of JP 4147199 B2 (Year: 2008).*

* cited by examiner

*Primary Examiner* — Connor J Tremarche
(74) *Attorney, Agent, or Firm* — SHIPWAY IP

(57) ABSTRACT

A seal structure configured to be located between a space forming member forming a columnar inner space and a columnar reciprocating member move in the inner space. The seal structure includes an annular seal member that is configured to be located in the inner space, an annular pressing portion which is located adjacent to the seal member and is configured to press the seal member in an axial direction, a compressive coil spring which is located adjacent to the pressing portion, and a cylindrical collar portion. The cylindrical collar portion is at least partially surrounded by the compressive coil spring to avoid interference between the compressive coil spring and the reciprocating member.

17 Claims, 4 Drawing Sheets

SEAL STRUCTURE FOR RECIPROCATING PUMP WITH CYLINDRICAL COLLAR PORTION

CROSS-REFERENCE TO RELATED APPLICATIONS

This application is based upon and claims the benefit of priority from Japanese Patent Application No. 2022-171539, filed on Oct. 26, 2022. The entire contents of which are incorporated herein by reference.

BACKGROUND

Field

The present disclosure relates to a seal structure and a reciprocating pump.

Description of the Related Art

Japanese Unexamined Patent Application Publication No. S63-57879 discloses a plunger pump. In this plunger pump, a seal member and a compressive coil spring are arranged on an inner peripheral portion of a seal casing that defines a pump chamber. As the seal member is pressed in an axial direction by a biasing force of the compressive coil spring, the seal member is positioned.

SUMMARY

Disclosed herein is an example seal structure. An example seal structure is disposed between a space forming member that forms a columnar inner space and a columnar reciprocating member that moves in a reciprocating manner in an axial direction in the inner space. The seal structure includes an annular seal member that is disposed in the inner space, an annular pressing portion which is disposed adjacent to the seal member and presses the seal member in the axial direction, a compressive coil spring which is disposed adjacent to the pressing portion, and a cylindrical collar portion which is surrounded by the compressive coil spring to avoid interference between the compressive coil spring and the reciprocating member.

Additionally, an example reciprocating pump is disclosed herein. An example reciprocating pump includes a cylinder portion, a plunger located in the cylinder portion and configured to move in a reciprocating manner in an axial direction in the cylinder portion. The reciprocating pump includes an annual seal member located between the plunger and the cylinder portion, a spring located between the plunger and the cylinder portion, and configured to press the seal member, and a cylindrical collar portion located between the plunger and the spring.

In some examples, space forming a so-called pump chamber is formed in a region on the front side of the seal member in the axial direction in the columnar inner space formed by the inner space forming member. Since the cylindrical collar portion is disposed in the compressive coil spring, a space in which the compressive coil spring is disposed and a space which constitutes the pump chamber are isolated from each other. Accordingly, the occurrence of cavitation may be suppressed.

In some examples, the pressing portion and the collar portion are integrally formed with each other. In some examples, the efficiency of the manufacturing process may be improved by decreasing the number of parts. Additionally, in an example, the pressing portion and the collar portion may be formed separately from each other.

In some examples, in a state in which a regulation member for regulating the position of the compressive coil spring is disposed in the inner space and the regulation member regulates the compressive coil spring, the length of the compressive coil spring in the axial direction is the same as the length of the collar portion in the axial direction. In some examples, since not only the compressive coil spring but also the collar portion press the pressing portion in the axial direction, the wire diameter of the compressive coil spring can be decreased.

In some examples, the seal member includes an annular concave portion having a V-shaped cross-section and serving as a contact surface with the pressing portion and the pressing portion includes an annular convex portion having a V-shaped cross-section corresponding to the concave portion and serving as a contact surface with the seal member. In this configuration, the misalignment of the axial centers of the seal member and the pressing portion are suppressed.

DETAILED DESCRIPTION

In the following description, with reference to the drawings, the same reference numbers are assigned to the same components or to similar components having the same function, and overlapping description is omitted.

Hereinafter, a reciprocating pump having an example seal structure will be described with reference to the accompanying drawings. As an example reciprocating pump, a so-called horizontal triple plunger pump in which three plungers constituting reciprocating members are arranged in parallel in the horizontal direction will be described. Additionally, in the following description, "up" and "down" are defined with reference to the state in which the reciprocating pump is placed on a horizontal plane, "front" and "rear" are defined with reference to the axial direction of the reciprocating member, the pump chamber side is defined as the front, and the crankcase side is defined as the rear.

Figure 1:
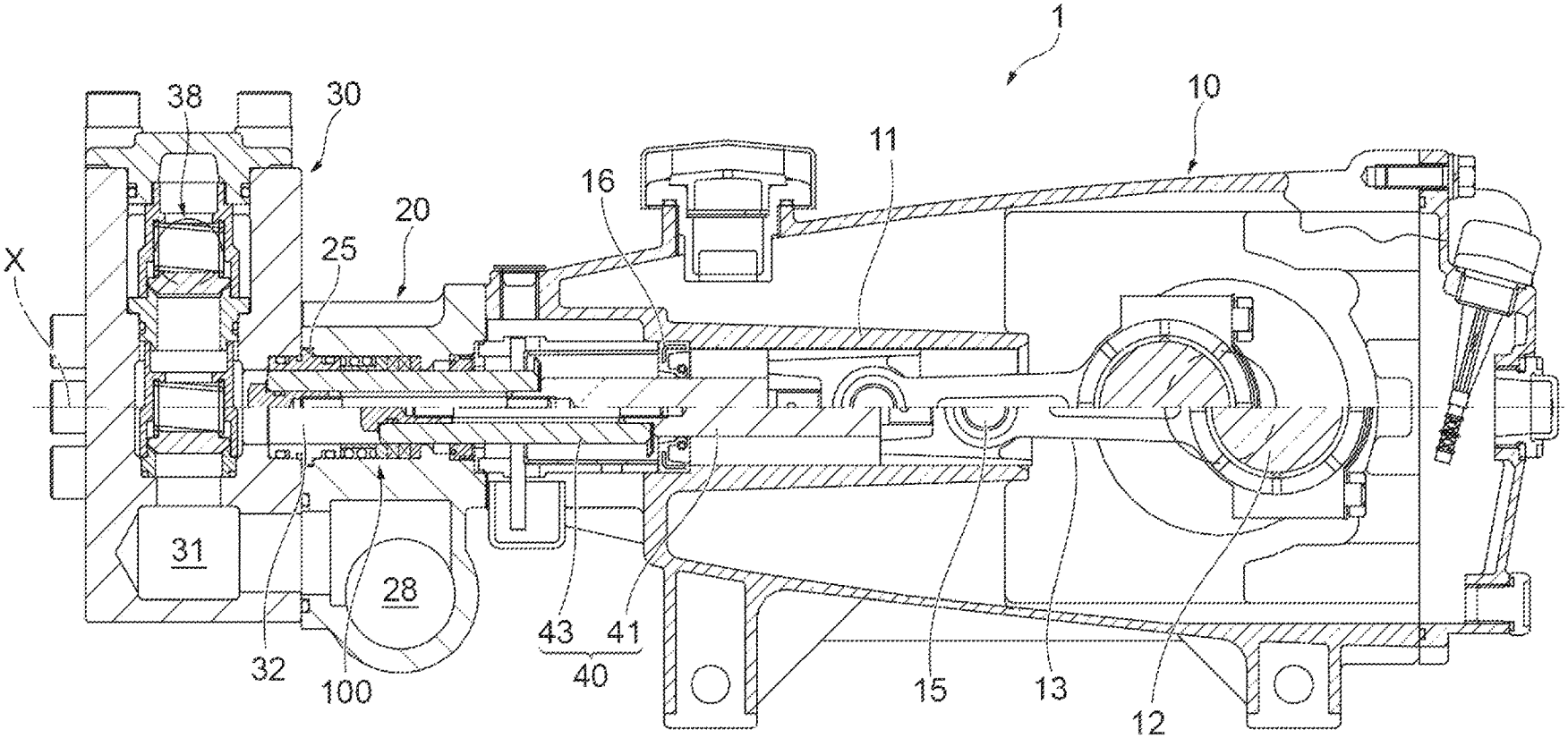
FIG. 1 is a cross-sectional view illustrating an example reciprocating pump.
Figure 2:
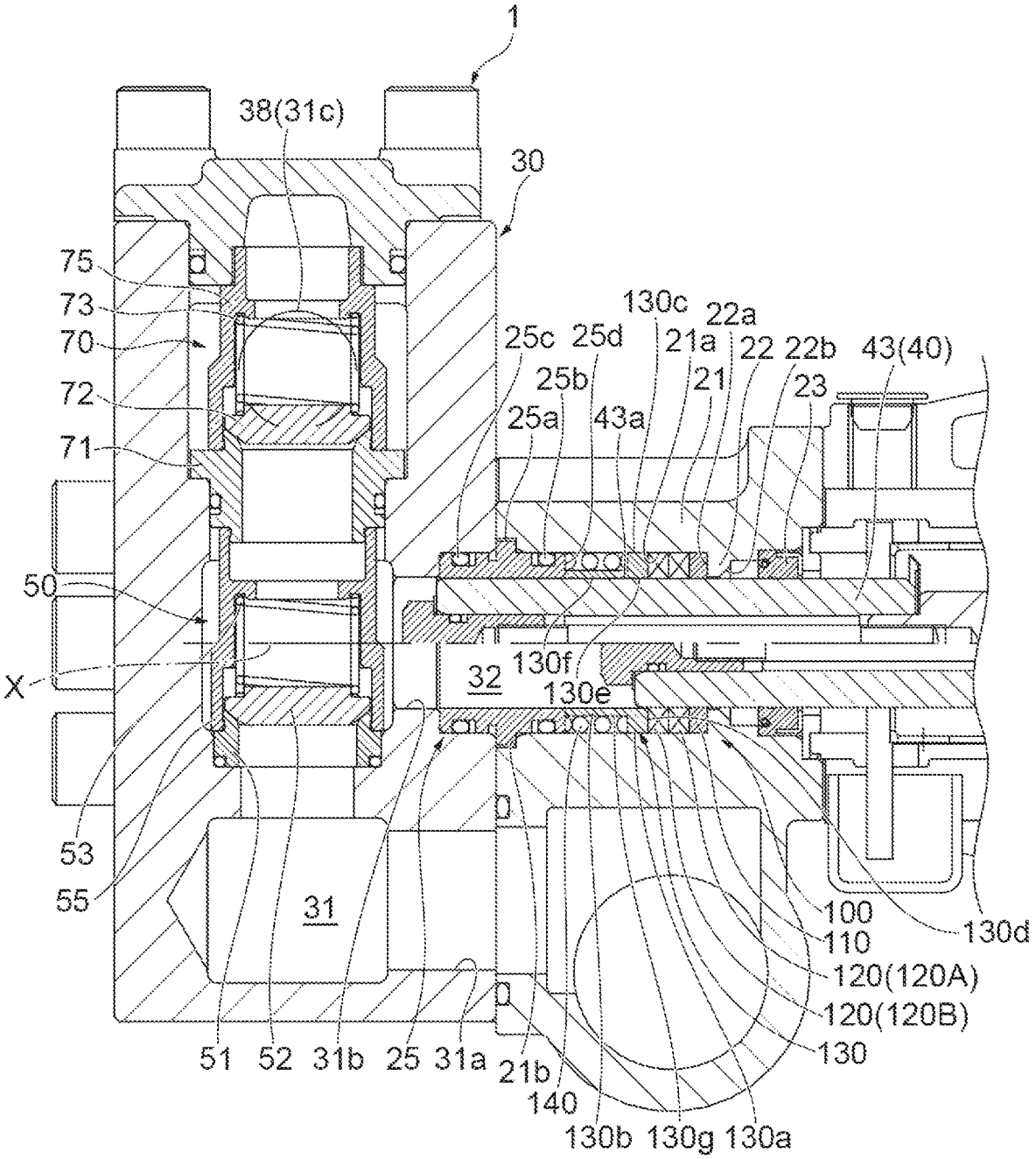
FIG. 2 is an enlarged cross-sectional view illustrating a seal structure of the reciprocating pump of FIG. 1.

FIG. 1 is a cross-sectional view illustrating one of three plunger pumps constituting an example reciprocating pump. In an example reciprocating pump 1, three pump configurations illustrated in FIG. 1 are arranged side by side in the horizontal direction (perpendicular to the paper surface of the figure). FIG. 2 is a partially enlarged view of FIG. 1. As illustrated in FIG. 1, the reciprocating pump 1 performs a pump action in a pump chamber 32 provided at a tip of a cylinder portion as a reciprocating member 40 moves in a reciprocating manner in a cylinder portion.

The reciprocating pump 1 includes a crankcase 10, a first manifold 20, and a second manifold 30. The crankcase 10, the first manifold 20, and the second manifold 30 are integrally connected to each other. The second manifold 30 is fixed to the crankcase 10 through the first manifold 20 by a plurality of fastening means (e.g., bolts and the like). Additionally, in FIGS. 1 and 2, a state in which the reciprocating member 40 is advanced and positioned at the top dead center is illustrated at the position above the axis X of the reciprocating member 40 indicated by a dashed line and a state in which the reciprocating member 40 is retreated and positioned at the bottom dead center is illustrated at the position below the axis X thereof.

The crankcase 10 is hollow A crankshaft 12, a connecting rod 13 rotatably connected to the crankshaft 12, a piston pin 15 rotatably connecting a plunger rod 41 to the connecting rod 13, and the like are arranged in the crankcase 10 and these members constitute a drive unit that reciprocates the reciprocating member 40 along the axis X. Additionally, the plunger rod 41 constitutes the rear half of the reciprocating member 40.

The crankcase 10 includes a cylinder portion 11. The cylinder portion 11 has a cylindrical shape and has an axial direction orthogonal to the axial direction of the crankshaft 12. The piston pin 15 and the tip of the connecting rod 13 can be arranged in the cylinder portion 11.

The crankcase 10 is filled with oil for lubricating and cooling the drive unit. An oil seal 16 for preventing the leakage of the oil in the crankcase 10 is disposed at an end portion on the side of the first manifold 20 of the cylinder portion 11. The oil seal 16 is in liquid-tight sliding contact with the outer peripheral surface of the plunger rod 41 that constitutes the reciprocating member 40. Then, the reciprocating member 40 moves in a reciprocating manner in the front and rear direction through the connecting rod 13 and the piston pin 15 as the crankshaft 12 rotates.

The first manifold 20 is disposed at the front end of the crankcase 10. Further, the second manifold 30 is disposed at the front end of the first manifold 20. The first manifold 20 includes a cylinder portion 21 (see FIG. 2) having a common center axis X with the cylinder portion 11. The cylinder portion 21 penetrates the first manifold 20 in the front and rear direction. A plunger 43 that constitutes the front half of the reciprocating member 40 is disposed in the cylinder portion 21. The plunger 43 moves in a reciprocating manner in the front and rear direction in the cylinder portion 21 in accordance with the rotation of the crankshaft 12.

As illustrated in FIG. 2, an annular stepped wall portion 22 is formed on an inner peripheral surface 21*a* of the cylinder portion 21. The stepped wall portion 22 protrudes toward the axis X of the cylinder portion 21. The stepped wall portion 22 protrudes toward the plunger 43. The stepped wall portion 22 of the illustrated example includes a front surface 22*a* which is perpendicular to the axial direction and a rear surface 22*b* which increases in diameter backward in cross-sectional view. In the cylinder portion 21, an annular low-pressure seal 23 such as a U-pacing is disposed behind the stepped wall portion 22. The low-pressure seal 23 seals a gap between the inner peripheral surface 21*a* of the cylinder portion 21 and an outer peripheral surface 43*a* of the plunger 43.

A communicating pipe 25 which is connected to the second manifold 30 is provided at the front end of the cylinder portion 21. For example, the communicating pipe 25 is formed in a cylindrical shape by metal or the like. The communicating pipe 25 is fitted to the cylinder portion 21 to protrude forward by a predetermined length from the cylinder portion 21. In the illustrated example, a stepped portion 21*b* which is recessed radially outward is formed at the front end of the cylinder portion 21. Further, an annular stepped portion 25*a* which protrudes radially outward is formed at the center of the communicating pipe 25 in the front and rear direction. When the communicating pipe 25 is fitted into the cylinder portion 21 from the front side of the cylinder portion 21, the stepped portion 25*a* of the communicating pipe 25 and the stepped portion 21*b* of the cylinder portion 21 come into contact with each other to position the communicating pipe 25. Accordingly, the distance from the rear end of the communicating pipe 25 to the stepped wall portion 22 is determined. Further, the distance of the communicating pipe 25 that protrudes forward from the first manifold 20 is determined. An O-ring 25*b* is provided at the rear end of the communicating pipe 25. A gap between the outer periphery of the communicating pipe 25 and the inner periphery of the cylinder portion 21 is sealed by the O-ring 25*b*. The communicating pipe 25 is an example of the regulation member.

A seal structure body (e.g., seal structure) 100 is disposed in the cylinder portion 21. The seal structure body 100 is disposed between the communicating pipe 25 and the stepped wall portion 22. The seal structure body 100 seals a gap between the inner peripheral surface 21*a* of the cylinder portion 21 and the outer peripheral surface 43*a* of the plunger 43 on the front side of the stepped wall portion 22. The seal structure body 100 has higher pressure resistance than that of the low-pressure seal 23.

Further, the first manifold 20 includes an inlet 28 for introducing working liquid, for example, water (see FIG. 1). The inlet 28 communicates with a flow path 31 formed in the second manifold 30. The inlet 28 of the illustrated example is positioned below the cylinder portion 21.

The first manifold 20 and the second manifold 30 include the pump chamber 32. As illustrated in FIG. 2, the communicating pipe 25 is fitted into the pump chamber 32. For example, since the communicating pipe 25 is accommodated across the inside of the second manifold 30 and the inside of the first manifold 20, the second manifold 30 and the first manifold 20 are connected to each other through the communicating pipe 25. An O-ring 25*c* is provided at the front end of the communicating pipe 25. A gap between the outer periphery of the communicating pipe 25 and the inner periphery of the pump chamber 32 is sealed by the O-ring 25*c*.

The flow path 31 of the second manifold 30 communicates with the inlet 28 of the first manifold 20 and also communicates with the outlet 38 formed in the second manifold 30. That is, the flow path 31 connects the inlet 28 and the outlet 38. Further, the flow path 31 also communicates with the pump chamber 32 at a position from the inlet 28 to the outlet 38. For example, the inside of the cylinder portion 21 is a part of the pump chamber 32 and the inside of the flow path 31 and the inside of the cylinder portion 21 fluidly coupled with each other by the communicating pipe 25. The flow path 31 of the illustrated example opens backward at the lower portion of the second manifold 30 and communicates with the inlet 28 through an opening 31*a*. Further, the flow path 31 extends in the up and down direction, communicates with the pump chamber 32 at the opening 31*b* formed at the center in the up and down direction, and communicates with the outlet 38 at the opening 31*c* formed at the upper portion.

An example valve assembly 50 for water absorption and a valve assembly 70 for discharge are accommodated in the flow path 31. The valve assembly 50 includes a tubular valve seat 51, a valve 52 which seals the valve seat 51, a biasing member (e.g., compressed coil spring) 53 which biases the valve 52 toward the valve seat 51, and a container 55 which accommodates the biasing member 53 and the valve 52. The valve assembly 50 is disposed in the flow path so that the valve 52 is positioned between the opening 31*b* communicating with the pump chamber 32 and the opening 31*a* communicating with the inlet.

The valve assembly 70 includes a tubular valve seat 71, a valve 72 which seals the valve seat 71, a biasing member (e.g., compressed coil spring) 73 which biases the valve 72 toward the valve seat 71, and a container 75 which accommodates the biasing member 73 and the valve 72. The valve assembly 70 is disposed in the flow path so that the valve 72 is positioned between the opening 31*b* communicating with the pump chamber 32 and the opening 31*c* communicating with the outlet 38.

The seal structure (e.g., the seal structure body 100) is disposed between a space forming member (e.g., the cylinder portion 21) forming the columnar inner space and a reciprocating member (e.g., the columnar plunger 43) moving in the inner space in a reciprocating manner. A columnar inner space is defined by the inner peripheral surface 21*a* of the cylinder portion 21, the front surface 22*a* of the stepped wall portion 22 formed in the cylinder portion 21, and a rear surface 25*d* of the communicating pipe 25.

As illustrated in FIG. 2, the seal structure body 100 includes a backup ring 110, an annular seal member 120, an adapter 130, and a compressive coil spring 140. The backup ring 110 is an annular member and is formed of, for example, a resin material such as polyacetal (POM) or fluororesin. A cross-section in the radial direction of the backup ring 110 has a rectangular shape. The rear end surface of the backup ring 110 contacts the front surface 22*a* of the stepped wall portion 22 formed in the inner space of the cylinder portion 21. The outer peripheral surface of the backup ring contacts the inner peripheral surface 21*a* of the cylinder portion 21. A slight clearance may be formed between the inner peripheral surface of the backup ring 110 and the outer peripheral surface 43*a* of the plunger 43.

The seal member includes an annular first packing (e.g., a first gland packing 120A) and an annular second packing (e.g., a second gland packing 120B). The first gland packing 120A and the second gland packing 120B are located surround the plunger 43. The first gland packing 120A and the second gland packing 120B are arranged between the adapter 130 and the backup ring 110.

The first gland packing 120A and the second gland packing 120B may have the same shape. The first gland packing 120A and the second gland packing 120B may have the different shape. The seal member 120 including the first gland packing 120A and the second gland packing 120B is an annular member and is formed of, for example, a material such as nitrile rubber (NBR) and fluorine rubber (FPM) (a rubber material, a resin material, or the like). The seal member 120 may have higher flexibility (elasticity) than the backup ring 110. A cross-section in the radial direction of the seal member 120 has a rectangular shape. The outer peripheral surface of the seal member 120 contacts the inner peripheral surface 21*a* of the cylinder portion 21. The inner peripheral surface of the seal member 120 may contact the outer peripheral surface 43*a* of the plunger 43. The first gland packing 120A is disposed adjacent to the backup ring 110 and the first gland packing 120A and the second gland packing 120B are provided in parallel in the axial direction. That is, the rear end surface of the first gland packing 120A contacts the front surface of the backup ring 110 and the rear end surface of the second gland packing 120B contacts the front end surface of the first gland packing 120A.

The adapter 130 is a tubular member that is disposed to surround the plunger 43. The adapter 130 is disposed adjacent to the second gland packing 120B. The adapter 130 may be formed of the same resin material as that of the backup ring 110. The adapter 130 includes a pressing portion 130*a* and a collar portion 130*b*. A cross-section in the radial direction of the pressing portion 130*a* has a rectangular shape. The pressing portion 130*a* is an annular portion which is disposed to surround the plunger 43 and is disposed adjacent to the second gland packing 120B. The rear end surface 130*d* of the pressing portion 130*a* contacts the front surface of the second gland packing 120B. The outer peripheral surface 130*c* of the pressing portion 130*a* contacts the inner peripheral surface 21*a* of the cylinder portion 21. A slight clearance may be formed between the inner peripheral surface 130*e* of the pressing portion 130*a* and the outer peripheral surface 43*a* of the plunger 43.

The collar portion 130*b* has a cylindrical shape. The collar portion 130*b* is formed continuously on the front surface of the pressing portion 130*a*. For example, the collar portion 130*b* and the pressing portion 130*a* are integrally formed with each other. The inner peripheral surface 130*f* of the collar portion 130*b* may be flush with the inner peripheral surface 130*e* of the pressing portion 130*a*. Further, the outer peripheral surface 130*g* of the collar portion 130*b* is separated from the inner peripheral surface 21*a* of the cylinder portion 21. The outer diameter of the collar portion 130*b* is smaller than the outer diameter of the pressing portion 130*a* (the inner diameter of the cylinder portion 21). The outer diameter of the collar portion 130*b* is smaller than the inner diameter of the cylinder portion 21. The front end of the collar portion 130*b* comes into contact with the rear surface 25*d* of the communicating pipe 25 and the collar portion 130*b* is pressed backward by the rear surface 25*d*. In this way, the communicating pipe 25 positions the collar portion 130*b*. The communicating pipe 25 is an example of a regulation member.

The compressive coil spring 140 is disposed to surround the plunger 43. The compressive coil spring 140 is disposed between the pressing portion 130*a* and the communicating pipe 25 in the axial direction. The compressive coil spring 140 comes into contact with the pressing portion 130*a* on the side opposite to the second gland packing 120B in the axial direction. The compressive coil spring 140 of the illustrated example is disposed adjacent to the pressing portion 130*a* on the outside of the collar portion 130*b*. The collar portion 130*b* is disposed in the compressive coil spring 140 to avoid interference between the compressive coil spring 140 and the plunger 43, e.g., so that the compressive coil spring 140 and the plunger 43 are spaced apart from each other. The compressive coil spring 140 is disposed between the plunger 43 and the compressive coil spring 140. A space in which the compressive coil spring 140 is disposed and the pump chamber 32 in which the plunger 43 moves in a reciprocating manner are isolated by the collar portion 130*b*.

In a natural state (e.g., an unloaded state), the length of the compressive coil spring 140 in the axial direction is formed to be longer than the length of the collar portion 130*b* in the axial direction. Since the compressive coil spring 140 is compressed in a state in which the seal structure body 100 is disposed between the communicating pipe 25 and the stepped wall portion 22 and the position of the front end of the compressive coil spring 140 is regulated by the communicating pipe 25, the length of the compressive coil spring 140 in the axial direction is the same as the length of the collar portion 130*b* in the axial direction. In this mode, the compressive coil spring 140 biases (presses) the pressing portion 130*a* (adapter 130) backward (toward the second gland packing 120B).

The reciprocating pump 1 illustrated in FIGS. 1 and 2, includes the cylinder portion 21 which includes the inner peripheral surface 21*a* defining the columnar inner space and the columnar plunger 43 which moves in a reciprocating manner in the axial direction in the inner space of the cylinder portion 21. The reciprocating pump 1 includes the annular seal member 120 which is disposed in the inner space, the annular pressing portion 130*a* which is disposed adjacent to the seal member 120 and presses the seal member 120 in the axial direction, and the compressive coil spring 140 which is disposed adjacent to the pressing portion 130*a*. The cylindrical collar portion 130*b* is disposed in (e.g., at least partially surrounded by) the compressive coil spring 140 to avoid interference between the compressive coil spring 140 and the plunger 43.

In the reciprocating pump 1, a space forming the pump chamber 32 is formed in a region on the front side of the seal member 120 the axial direction in the columnar inner space formed by the cylinder portion 21. Since the cylindrical collar portion 130*b* is disposed in the compressive coil spring 140, a space in which the compressive coil spring 140 is disposed and a space which constitutes the pump chamber 32 are isolated. Accordingly, the occurrence of cavitation is suppressed. The cylinder portion is an example of an inner space forming member.

In an example seal structure (e.g., the seal structure body 100) illustrated in FIGS. 1 and 2, an increase in the volume of the pump chamber 32 is substantially suppressed. Accordingly, since the compression ratio of the pump increases, the water absorption efficiency can be improved. In the seal structure body 100 illustrated in FIGS. 1 and 2, the displacement of the compressive coil spring 140 in the radial direction (the direction intersecting the axial direction) is suppressed. In this mode, eccentricity of the load position of the compressive coil spring 140 with respect to the seal member 120 can be suppressed. In this mode, the compressive coil spring 140 is prevented from contacting the plunger 43.

In an example, the regulation member (e.g., communicating pipe 25) for regulating the position of the compressive coil spring 140 is disposed in the inner space of the cylinder portion 21. The communicating pipe 25 holds the compressive coil spring 140 between the pressing portion 130*a* and the communicating pipe and comes into contact with the collar portion 130*b*. In a state in which the communicating pipe 25 regulates the position of the compressive coil spring 140, the length of the compressive coil spring 140 in the axial direction is the same as the length of the collar portion 130*b* in the axial direction. In this configuration, since not only the compressive coil spring 140 but also the collar portion 130*b* presses the pressing portion 130*a* in the axial direction, the wire diameter of the compressive coil spring 140 can be decreased.

Figure 3:
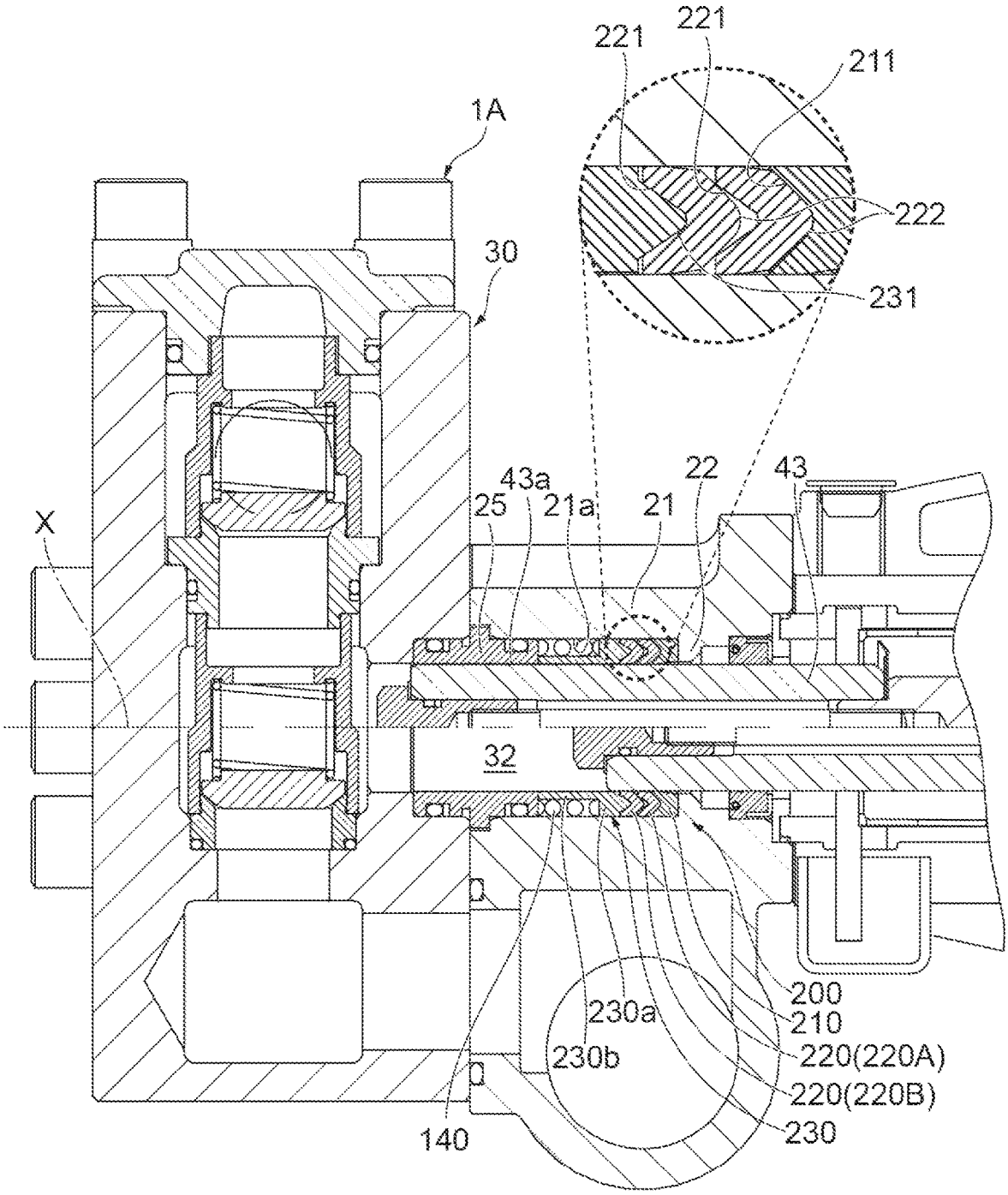
FIG. 3 is a cross-sectional view illustrating an example seal structure.

FIG. 3 is a cross-sectional view illustrating an example seal structure (e.g., a seal structure body 200). A reciprocating pump 1A illustrated in FIG. 3 includes a seal structure body 200. The seal structure body 200 includes backup ring (e.g., a female adapter 210), an annular seal member 220, a male adapter 230, and a compressive coil spring 140. The seal member 220 includes a first packing (e.g., a first V-packing 220A) and a second packing (e.g., a second V-packing 220B).

The female adapter 210 is an annular member and is formed of the same resin material as that of the backup ring 110. The rear end surface of the female adapter 210 contacts the stepped wall portion 22 formed in the inner space of the cylinder portion 21 and is formed in a flat shape. The outer peripheral surface of the female adapter 210 contacts the inner peripheral surface 21*a* of the cylinder portion 21. A slight clearance may be formed between the inner peripheral surface of the female adapter 210 and the outer peripheral surface 43*a* of the plunger 43. A concave portion (e.g., groove 211) which has a V-shaped cross-section recessed backward is formed on the front surface of the female adapter 210.

The first V-packing 220A and the second V-packing 220B have the same shape. When they are not distinguished from each other, the first V-packing 220A and the second V-packing 220B are referred to as the V-packing 220. The V-packing 220 is an annular member and may formed of the same resin material as that of the seal member 120. The outer peripheral surface of the V-packing 220 contacts the inner peripheral surface 21*a* of the cylinder portion 21. The inner peripheral surface of the V-packing 220 may contact the outer peripheral surface 43*a* of the plunger 43. The first V-packing 220A is disposed adjacent to the female adapter 210 and the first V-packing 220A and the second V-packing 220B are provided in parallel in the axial direction. For example, the rear end surface of the first V-packing 220A contacts the front surface of the female adapter 210 and the rear end surface of the second V-packing 220B contacts the front end surface of the first V-packing 220A. A cross-section in the radial direction of the V-packing 220 has a substantially V shape. For example, the rear surface of the V-packing 220 includes a convex portion 222 have a V-shaped cross-section protruding backward and the front surface of the V-packing 220 includes a groove (concave portion) 221 having a V-shaped cross-section recessed backward. The shape of the convex portion 222 of the V-packing 220 corresponds to the shape of the groove 211 of the female adapter 210. Thus, when the V-packing 220 is pressed toward the female adapter 210, the convex portion 222 is in close contact with the groove 211. Further, the shape of the convex portion 222 of the V-packing 220 also corresponds to the shape of the groove 221 of the V-packing 220. Thus, when the second V-packing 220B is pressed toward the first V-packing 220A, the convex portion 222 of the second V-packing 220B is in close contact with the groove 221 of the first V-packing 220A.

The male adapter 230 is disposed adjacent to the second V-packing 220B. The male adapter 230 may be formed of the same resin material as that of the female adapter 210. The male adapter 230 includes a pressing portion 230*a* and a collar portion 230*a*. The rear end surface of the pressing portion 230*a* contacts the front surface of the second V-packing 220B. The outer peripheral surface of the pressing portion 230*a* contacts the inner peripheral surface 21*a* of the cylinder portion 21. A slight clearance may be formed between the inner peripheral surface of the pressing portion 230*a* and the outer peripheral surface 43*a* of the plunger 43. A convex portion 231 having a V-shaped cross-section protruding backward is formed on the rear surface of the pressing portion 230*a*. The shape of the convex portion 231 of the pressing portion 230*a* corresponds to the shape of the groove 221 of the second V-packing 220B. Thus, when the pressing portion 230*a* is pressed toward the second V-packing 220B, the convex portion 231 is in close contact with the groove 221.

The collar portion 230*b* has a cylindrical shape. The collar portion 230*b* is continuously formed on the front surface of the pressing portion 230*a*. For example, the collar portion 230*b* and the pressing portion 230*a* are integrally formed with each other. The inner peripheral surface of the collar portion 230*b* is flush with the inner peripheral surface of the pressing portion 230*a*. Further, the outer peripheral surface of the collar portion 230*b* is separated from the inner peripheral surface 21*a* of the cylinder portion 21. That is, the outer diameter of the collar portion 230*b* is smaller than the outer diameter of the pressing portion 230*a*. The front end of the collar portion 230*b* is pressed backward by the rear surface 25*d* of the communicating pipe 25.

The compressive coil spring 140 of the illustrated example is disposed adjacent to the pressing portion 230*a* on the outside of the collar portion 230*b*. For example, the collar portion 230*b* is disposed in the compressive coil spring 140 to avoid interference between the compressive coil spring 140 and the plunger 43. A space in which the compressive coil spring 140 is disposed and the pump chamber 32 in which the plunger 43 moves in a reciprocating manner are isolated by the collar portion 230*a*.

In a natural state, the length of the compressive coil spring 140 in the axial direction is formed to be longer than the length of the collar portion 230*b* in the axial direction. Since the compressive coil spring 140 is compressed in a state in which the seal structure body 200 is disposed between the communicating pipe 25 and the stepped wall portion 22 and the position of the front end of the compressive coil spring 140 is regulated by the communicating pipe 25, the length of the compressive coil spring 140 in the axial direction is the same as the length of the collar portion 230*b* in the axial direction. In this state, the compressive coil spring 140 biases the pressing portion 230*a* (male adapter 230) backward.

As described above, in the mode illustrated in FIG. 3, the V-packing 220 includes an annular groove 221 which has a V-shaped cross-section and serves as a contact surface with the pressing portion 230*a* and the pressing portion 230*a* includes an annular convex portion 231 which has a V-shaped cross-section corresponding to the groove 221 and serves as a contact surface with the V-packing 220. In this configuration, the misalignment of the axial centers of the V-packing 220 and the pressing portion 230*a* is suppressed. Further, since the load of the compressive coil spring 140 reliably acts on the groove 221 of the V-packing 220, the uneven wear of the V-packing 220 is suppressed and the durability of the V-packing 220 is improved.

Figure 4:
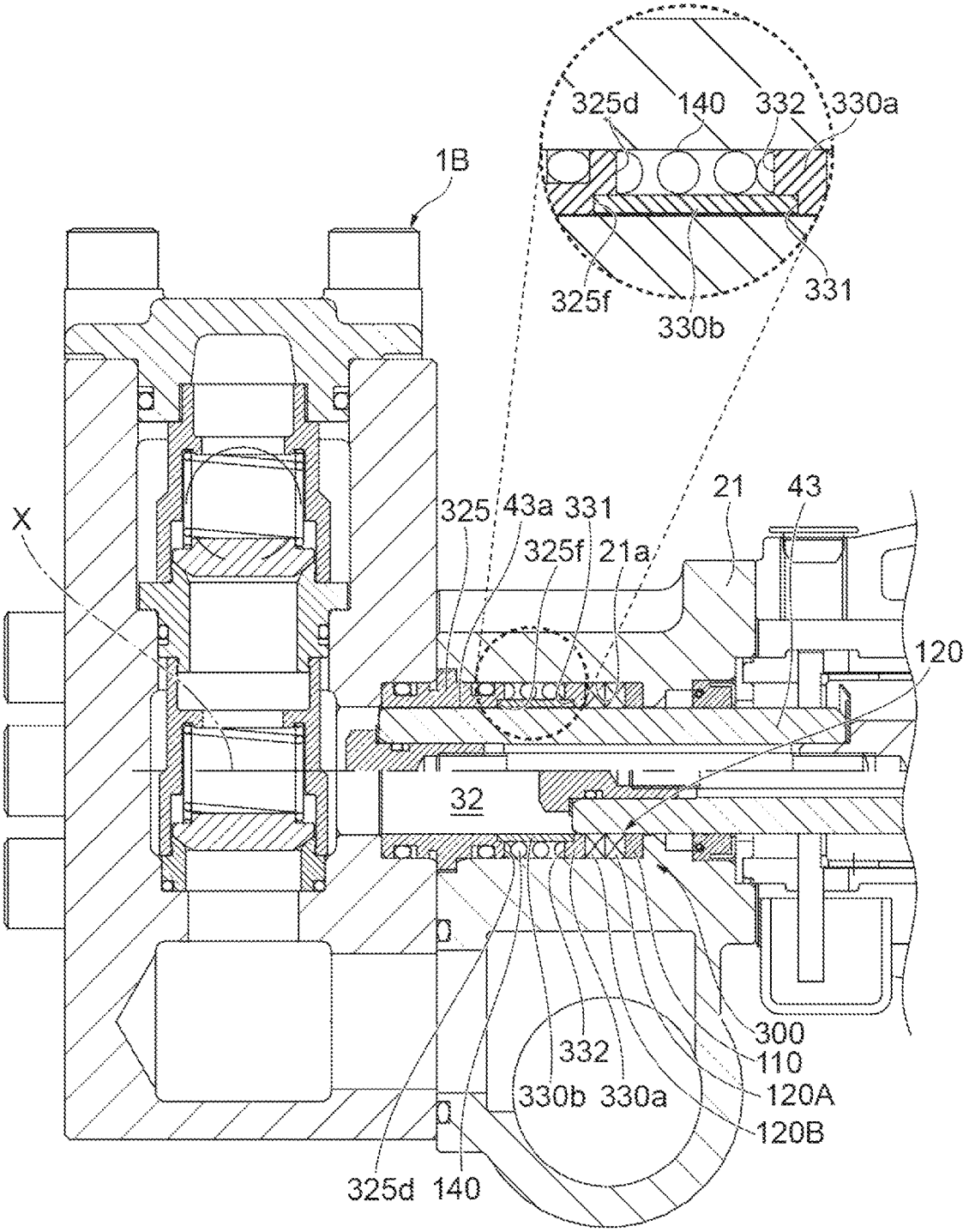
FIG. 4 is a cross-sectional view illustrating another example seal structure.

FIG. 4 is a cross-sectional view illustrating an example seal structure (e.g., a seal structure body 300). A reciprocating pump 1B illustrated in FIG. 4 includes a seal structure body 300. The seal structure body 300 includes the backup ring 110, the sealing member 120, a pressing member 330*a*, a collar member 330*b*, and the compressive coil spring 140. The reciprocating pump 1B of FIG. 4 includes a communicating pipe 325 instead of the communicating pipe 25. The sealing member 120 includes a first packing (e.g., the first gland packing 120A) and a second packing (e.g., the second gland packing 120B).

The communicating pipe 325 is different from the communicating pipe 25 only in that a stepped portion 325*f* is provided. The stepped portion 325*f* is formed along the inner edge of the rear surface 325*d* of the communicating pipe 325. The stepped portion 325*f* has a rectangular cross-section and is recessed forward from the rear surface 325*d*.

The pressing member 330*a* has an annular shape. A cross-section in the radial direction of the pressing member 330*a* has a rectangular shape. The rear end surface of the pressing member 330*a* contacts the front surface of the second gland packing 120B. The outer peripheral surface 130*c* of the pressing member 330*a* contacts the inner peripheral surface 21*a* of the cylinder portion 21. A slight clearance may be formed between the inner peripheral surface 130*e* of the pressing member 330*a* and the outer peripheral surface 43*a* of the plunger 43. A stepped portion 331 is formed on the front surface 332 of the pressing member 330*a*. The stepped portion 331 is formed along the inner periphery of the front surface 332. The stepped portion 331 has a rectangular cross-section and is recessed backward from the front surface 332.

The collar member 330*b* has a cylindrical shape similarly to the collar portion 130*b* and is disposed in the compressive coil spring 140. Further, the collar member 330*b* is disposed between the stepped portion 331 of the pressing portion 130*a* and the stepped portion 325*f* of the communicating pipe 325. The inner peripheral surface 130*f* of the collar member 330*b* is flush with the inner peripheral surface 130*e* of the pressing member 330*a*. Further, the outer peripheral surface 130*g* of the collar member 330*b* is separated from the inner peripheral surface 21*a* of the cylinder portion 21. That is, the outer diameter of the collar member 330*b* is smaller than the outer diameter of the pressing member 330*a*.

In the example illustrated in FIG. 2, the collar portion 130*b* (e.g., collar member 330*b*) and the pressing portion 130*a* (e.g., pressing member 330*a*) are integrally formed with each other to form the adapter 130. The collar portion 130*b* (e.g., collar member 330*b*) and the pressing portion 130*a* (e.g., pressing member 330*a*) may be formed separately from each other as illustrated in FIG. 4. In the mode that the pressing portion 130*a* and the collar portion 130*b* are integrally formed with each other as in the example of FIG. 2, it may improve the efficiency of the manufacturing process by decreasing the number of parts.

Some example seal structures illustrated FIGS. 1-4 may be applied not only to the inside of the cylinder adjacent to the pump chamber, but also to the inside of the cylinder arranged in other parts.

In FIG. 4, an example is illustrated in which the collar portion 130*b* and the pressing portion 130*a* of the adapter 130 of FIG. 2 are formed separately from each other. However, the collar portion 230*b* and the pressing portion 230*a* constituting the male adapter 230 of FIG. 3 may be formed separately from each other. An example collar portion may be formed as a part of a communicating pipe. An example communicating pipe may include the cylindrical collar portion disposed in the compressive coil spring.

Some example seal structure bodies illustrated in FIGS. 1-4 are sandwiched between the rear end of the communicating pipe and the stepped wall portion of the cylinder portion. However, the seal structure body may be sandwiched between two facing surfaces and the arrangement between the surfaces may be changed depending on the target to which the seal structure is applied.

Some additional examples based on the drawings are disclosed as follows.

An example reciprocating pump (1, 1A, 1B) includes a cylinder portion (21), a plunger (43) located in the cylinder portion (21) and configured to move in a reciprocating manner in an axial direction in the cylinder portion (21). The reciprocating pump (1, 1A, 1B) includes an annual seal member (120, 220) located between the plunger (43) and the cylinder portion (21), a spring (140) located between the plunger (43) and the cylinder portion (21), which is configured to press the seal member (120, 120A, 120B), and a cylindrical collar portion (130*b*, 230*b*, 330*b*) located between the plunger (43) and the spring (140).

The reciprocating pump (1) may include a pressing portion (130*a*, 230*a*, 330*a*) located between the spring (140) and the seal member (120, 220). The spring (140) may be configured to press the seal member (120, 220) via the pressing portion (130*a*, 230*a*, 330*a*).

The spring (140) may include a compressive coil spring which is located around the collar portion (130*b*, 230*b*, 330*b*) and abuts the pressing portion (130*a*, 230*a*, 330*a*).

The pressing portion (130*a*) may include an annual outer peripheral surface (130*c*) abutting the cylinder portion (21).

The pressing portion (130*a*, 230*a*) and the collar portion (130*b*, 230*b*) are integrally formed with each other, and are made of resin.

The pressing portion (130*a*) and the collar portion (130*b*) may be integrally formed with each other, and are made of resin. An inner peripheral surface (130*f*) of the collar portion (130*b*) may be flush with an inner peripheral surface (130*e*) of the pressing portion (130*a*).

The pressing portion (130*a*) and the collar portion (130*b*) may be integrally formed with each other, and may be made of resin. An outer diameter of the collar portion (130*b*) may be smaller than an outer diameter of the pressing portion (130*a*).

An outer peripheral surface (130*g*) of the collar portion (130*b*) may be separated from an inner peripheral surface (21*a*) of the cylinder portion (21). An outer peripheral surface (130*c*) of the pressing portion (130*a*) may abut the inner peripheral surface (21*a*) of the cylinder portion (21).

The reciprocating pump (1) may include a regulation member (25, 325) abutting the collar portion (130*b*, 230*b*, 330*b*) in the axial direction. The regulation member (25, 325) may be configured to press the spring (140) between the regulation member (25) and the pressing portion (130*a*, 230*a*, 330*b*).

The reciprocating pump (1) may include a manifold (30) connected to the cylinder portion (21) and configured to form a pump chamber (32) therein, and a communicating pipe (25,325) located in the pump chamber (32) and configured to fluidly couple the manifold (30) and the cylinder portion (21). The spring (140) may be located between the communicating pipe (25) and the seal member (120, 220).

The communicating pipe (25, 325) may be configured to abut the collar portion (130*b*, 230*b*, 330*b*) and position the collar portion (130*b*, 230*b*, 330*b*).

The cylinder portion (21) may include an inner peripheral surface (21*a*) forming a part of the pump chamber (32), and an annular stepped wall portion (22) protruding toward the plunger (43) on the inner peripheral surface (21*a*). The spring (140), the collar portion (130*b*, 230*b*, 330*b*) and the seal member (120) may be located between the communicating pipe (25, 325) and the stepped wall portion (22).

The cylinder portion (21) may include an inner peripheral surface (21*a*) facing the plunger (43) and an annular stepped wall portion (22) protruding toward the plunger (43) on the inner peripheral surface (21*a*). The seal member (120) may be located between the pressing portion (130*a*, 230*a*, 330*a*) and the stepped wall portion (22).

The reciprocating pump (1) may include a backup ring (110) made of resin and located between the seal member (120, 220) and the stepped wall portion (22). The seal member (120, 220) comprises an annular first packing (120A, 220A) abutting the backup ring (110) and an annular second packing (120B, 220B) adjacent to the first gland packing (120A, 220A) in the axial direction and abutting the pressing portion (130*a*, 230*a*, 330*a*).

It is to be understood that not all aspects, advantages and features described herein may necessarily be achieved by, or included in, any one particular example. Indeed, having described and illustrated various examples herein, it should be apparent that other examples may be modified in arrangement and detail.

What is claimed is:

1. A seal structure configured to be located between a cylinder of a reciprocating pump forming a columnar inner space and a columnar reciprocating member of the reciprocating pump moving in a reciprocating manner in an axial direction in the inner space, the seal structure comprising:

an annular seal member that is configured to be located in the inner space;

an annular pressing portion which is located adjacent to the seal member and is configured to press the seal member in the axial direction;

a compressive coil spring which is located adjacent to the pressing portion;

a cylindrical collar formed integrally with the pressing portion, wherein the cylindrical collar is at least partially surrounded by the compressive coil spring to avoid interference between the compressive coil spring and the reciprocating member; and a regulation pipe configured to regulate a position of the compressive coil spring and having an outer cylindrical surface extending in the axial direction and partially located in the inner space, the regulation pipe including an annular stepped portion which protrudes from the outer cylindrical surface radially outward to contact the cylinder in the axial direction, wherein the annular stepped portion is located approximately at a center of the regulation pipe in the axial direction, wherein a first end of the regulation pipe extends from the annular stepped portion in the axial direction and contacts both the compressive coil spring and the cylindrical collar in the axial direction, and wherein a second end of the regulation pipe extends from the annular stepped portion in the axial direction opposite to the first end, the second end protruding outside of the cylinder in the axial direction.

2. The seal structure according to claim 1, further comprising a backup ring located between the reciprocating member and the cylinder, wherein a clearance is formed between the reciprocating member and the backup ring in the radial direction, and wherein the seal member is located between the pressing portion and the backup ring in the axial direction and separates the pressing portion from the backup ring.

3. A reciprocating pump comprising:

a cylinder portion including an inner peripheral surface;

a plunger located in the cylinder portion and configured to move in a reciprocating manner in an axial direction in the cylinder portion;

a stepped wall portion integrally formed with the cylinder portion and protruding from the inner peripheral surface toward the plunger in a radial direction of the cylinder portion, the stepped wall portion spaced away from an end of the cylinder portion in the axial direction;

a seal structure comprising:

an annular seal member located between and contacting both the plunger and the inner peripheral surface of the cylinder portion;

a spring located between the plunger and the cylinder portion in the radial direction, and configured to press the seal member toward the stepped wall portion;

a communicating pipe having an outer cylindrical surface extending in the axial direction and partially located in the cylinder portion, the communicating pipe including an annular stepped portion which protrudes outward from the outer cylindrical surface in the radial direction; and a backup ring including an inner ring surface facing the plunger and forming a clearance between the plunger and the inner peripheral surface of the cylinder portion in the radial direction, the backup ring located between and contacting both the seal member and the stepped wall portion in the axial direction;

a cylindrical collar located between the plunger and the spring; and a pressing portion integrally formed with the cylindrical collar and located between the plunger and the inner peripheral surface of the cylinder portion in the radial direction, the pressing portion located between the spring and the seal member in the axial direction and contacting the seal member, wherein the cylinder portion includes a recessed portion which contacts the annular stepped portion of the communicating pipe in the axial direction to regulate a position of the spring, wherein the reciprocating pump includes a manifold having a flow passage that is fluidly coupled to the communicating pipe, wherein a first end of the communicating pipe extends in the axial direction from the annular stepped portion and contacts the spring in the axial direction, wherein a second end of the communicating pipe extends from the annular stepped portion in the axial direction opposite to the first end, the second end located in the flow passage of the manifold, wherein the spring is configured to press the seal member via the pressing portion, wherein the seal member is located between the pressing portion and the backup ring in the axial direction so that the pressing portion is separated from the backup ring, wherein the second end of the communicating pipe abuts the cylindrical collar in the axial direction, wherein the communicating pipe is configured to press the spring between the communicating pipe and the pressing portion, and wherein the annular stepped portion is located approximately at a center of the communicating pipe in the axial direction.

4. The reciprocating pump according to claim 3, wherein the pressing portion and the cylindrical collar are integrally formed with each other, and are made of resin, wherein an inner peripheral surface of the cylindrical collar is flush with an inner peripheral surface of the pressing portion, and wherein a clearance is formed between the plunger and the inner peripheral surfaces in the radial direction.

5. The reciprocating pump according to claim 4, wherein an outer diameter of the cylindrical collar is smaller than an outer diameter of the pressing portion.

6. The reciprocating pump according to claim 3, wherein the cylindrical collar is located between the plunger and the spring in the axial direction, wherein the seal member is located between the cylindrical collar and the backup ring in the axial direction, and wherein the communicating pipe is configured to abut the cylindrical collar and position the cylindrical collar.

7. The reciprocating pump according to claim 3, wherein the cylindrical collar is located between the plunger and the spring in the radial direction, wherein the inner peripheral surface of the cylinder portion is fluidly coupled to the flow passage of the manifold via the communicating pipe, the inner peripheral surface forming a part of a pump chamber in which the plunger is located, and wherein the cylindrical collar is located between the communicating pipe and the stepped wall portion in the axial direction.

8. The reciprocating pump according to claim 3, wherein the seal member comprises an annular first packing abutting the backup ring and an annular second packing adjacent to the first packing in the axial direction and abutting the pressing portion.

9. The reciprocating pump according to claim 3, further comprising:

a first seal ring located between the communicating pipe and the cylinder portion in the axial direction; and a second seal ring located between the communicating pipe and the manifold in the axial direction, wherein the annular stepped portion of the communicating pipe is located between the first seal ring and the second seal ring in the axial direction.

10. The reciprocating pump according to claim 3, wherein the manifold contacts the second end of the communicating pipe and sandwiches the annular stepped portion between the manifold and the recessed portion in the axial direction.

11. The reciprocating pump according to claim 3, wherein the flow passage includes a pump chamber receiving the second end of the communicating pipe, and wherein the reciprocating pump includes a seal ring located between the outer cylindrical surface of the second end and the manifold in the pump chamber.

12. The reciprocating pump according to claim 3, wherein the cylindrical collar is located between the plunger and the spring in the radial direction, wherein the pressing portion protrudes outward from the cylindrical collar in the radial direction, and wherein the pressing portion includes an end surface that contacts the seal member in the axial direction.

13. A reciprocating pump comprising:

a cylinder portion including an inner peripheral surface;

a plunger located in the cylinder portion and configured to move in a reciprocating manner in an axial direction in the cylinder portion;

a stepped wall portion integrally formed with the cylinder portion and protruding from the inner peripheral surface toward the plunger in a radial direction of the cylinder portion, the stepped wall portion spaced away from an end of the cylinder portion in the axial direction;

a seal structure comprising:

an annular seal member located between and contacting both the plunger and the inner peripheral surface of the cylinder portion;

a spring located between the plunger and the cylinder portion in the radial direction, and configured to press the seal member toward the stepped wall portion;

a communicating pipe having an outer cylindrical surface extending in the axial direction and partially located in the cylinder portion, the communicating pipe including an annular stepped portion which protrudes outward from the outer cylindrical surface in the radial direction; and a backup ring including an inner ring surface facing the plunger and forming a clearance between the plunger and the inner peripheral surface of the cylinder portion in the radial direction, the backup ring located between and contacting both the seal member and the stepped wall portion in the axial direction; and a second seal member located between the plunger and the inner peripheral surface of the cylinder portion in the radial direction, the second seal member having a lower pressure resistance than the seal member, wherein the cylinder portion includes a recessed portion which contacts the annular stepped portion of the communicating pipe in the axial direction to regulate a position of the spring, wherein the reciprocating pump includes a manifold having a flow passage that is fluidly coupled to the communicating pipe, wherein a first end of the communicating pipe extends in the axial direction from the annular stepped portion and contacts the spring in the axial direction, wherein a second end of the communicating pipe extends from the annular stepped portion in the axial direction opposite to the first end, the second end located in the flow passage of the manifold, and wherein the stepped wall portion is located between the second seal member and the backup ring in the axial direction, the stepped wall portion including:

a front surface contacting the backup ring; and a tapered surface located between the front surface and the second seal member in the axial direction.

14. The reciprocating pump according to claim 13, wherein the front surface of the stepped wall portion is perpendicular to the axial direction, and wherein an end surface of the backup ring is perpendicular to the axial direction and contacts the front surface of the stepped wall portion in the axial direction.

15. The reciprocating pump according to claim 14, wherein the stepped wall portion includes an inner circumferential surface that faces the plunger, and wherein the tapered surface of the stepped wall portion is tapered away from the plunger such that a diameter of the tapered surface uniformly increases in the axial direction from the inner circumferential surface of the stepped wall portion toward the second seal member.

16. A reciprocating pump comprising:

a cylinder portion including an inner peripheral surface;

a plunger located in the cylinder portion and configured to move in a reciprocating manner in an axial direction in the cylinder portion;

a first seal member located between the plunger and the inner peripheral surface and contacting the plunger and the inner peripheral surface in a radial direction of the cylinder portion;

a spring located between the plunger and the inner peripheral surface in the radial direction, and configured to press the first seal member;

a communicating pipe partially located in the cylinder portion and contacting the spring to regulate a position of the spring;

a backup ring located between the plunger and the cylinder portion in the axial direction and contacting the first seal member, the backup ring including an inner ring surface spaced apart from and facing the plunger;

a second seal member located between the plunger and the inner peripheral surface of the cylinder portion; and a stepped wall portion integrally formed with the cylinder portion and protruding from the inner peripheral surface toward the plunger, the stepped wall portion located between the backup ring and the second seal member in the axial direction, wherein the stepped wall portion includes:

a front surface contacting the backup ring;

a tapered surface located between the front surface and the second seal member in the axial direction; and an inner circumferential surface that connects the front surface to the tapered surface and faces the plunger, and wherein the tapered surface of the stepped wall portion is tapered away from the plunger such that a diameter of the tapered surface uniformly increases in the axial direction from the inner circumferential surface of the stepped wall portion toward the second seal member.

17. A reciprocating pump comprising:

a cylinder portion including an inner peripheral surface;

a plunger located in the cylinder portion and configured to move in a reciprocating manner in an axial direction in the cylinder portion;

a first seal member located between the plunger and the inner peripheral surface and contacting the plunger and the inner peripheral surface in a radial direction of the cylinder portion;

a spring located between the plunger and the inner peripheral surface in the axial direction, and configured to press the first seal member;

a communicating pipe partially located in the cylinder portion and contacting the spring to regulate a position of the spring;

a backup ring located between the plunger and the cylinder portion in the axial direction and contacting the first seal member, the backup ring including an inner ring surface spaced apart from and facing the plunger;

a second seal member located between the plunger and the inner peripheral surface of the cylinder portion; and a stepped wall portion integrally formed with the cylinder portion and protruding from the inner peripheral surface toward the plunger, the stepped wall portion located between the backup ring and the second seal member in the axial direction, wherein the communicating pipe includes:

an outer cylindrical surface extending in the axial direction and partially located in the cylinder portion; and an annular stepped portion which protrudes outward from the outer cylindrical surface in the radial direction, the annular stepped portion located approximately at a center of the communicating pipe in the axial direction, wherein the cylinder portion includes a recessed portion extending outward from the inner peripheral surface in the radial direction, the recessed portion receiving the annular stepped portion and contacting the annular stepped portion in the axial direction to regulate a position of the spring, and wherein the stepped wall portion is located between the recessed portion and the second seal member in the axial direction.

* * * * *